US007935036B2

(12) United States Patent
Haynes

(10) Patent No.: US 7,935,036 B2
(45) Date of Patent: May 3, 2011

(54) EXERCISE AND TRAINING APPARATUS

(76) Inventor: George Haynes, Jacksonville, NC (US)

( * ) Notice: Subject to any disclaimer, the term of this patent is extended or adjusted under 35 U.S.C. 154(b) by 15 days.

(21) Appl. No.: 12/235,036

(22) Filed: Sep. 22, 2008

(65) Prior Publication Data

US 2009/0082183 A1 Mar. 26, 2009

Related U.S. Application Data

(60) Provisional application No. 60/974,235, filed on Sep. 21, 2007.

(51) Int. Cl.
*A63B 21/02* (2006.01)

(52) U.S. Cl. ..... 482/124; 482/121

(58) Field of Classification Search ..... 482/121, 482/124–125, 74, 122–123, 126; 2/69
See application file for complete search history.

(56) References Cited

U.S. PATENT DOCUMENTS

| | | | | |
|---|---|---|---|---|
| 4,335,875 | A | 6/1982 | Elkin | |
| 4,441,707 | A | 4/1984 | Bosch | |
| 4,789,154 | A | 12/1988 | Mattox | |
| 4,832,333 | A | 5/1989 | Lockett | |
| 5,116,359 | A | 5/1992 | Moore | |
| 5,129,647 | A | 7/1992 | Castellanos | |
| 5,234,395 | A | 8/1993 | Miller et al. | |
| 5,250,016 | A | 10/1993 | Higgins | |
| 5,484,366 | A * | 1/1996 | Wilkinson | 482/105 |
| 5,498,218 | A | 3/1996 | Proctor et al. | |
| 5,514,059 | A * | 5/1996 | Romney | 482/124 |
| 5,618,249 | A * | 4/1997 | Marshall | 482/127 |
| 5,662,554 | A | 9/1997 | Schaefer | |
| 5,681,248 | A * | 10/1997 | Vani | 482/126 |
| 5,727,254 | A | 3/1998 | Dicker | |
| 5,743,838 | A * | 4/1998 | Willis | 482/124 |
| 5,993,357 | A | 11/1999 | Tom et al. | |
| 6,036,625 | A | 3/2000 | Woodruff | |
| 6,093,137 | A | 7/2000 | Summers | |
| 6,099,445 | A | 8/2000 | Rovinsky et al. | |
| 6,179,747 | B1 | 1/2001 | Kelley | |
| 6,244,998 | B1 * | 6/2001 | Hinds | 482/126 |
| 6,551,214 | B1 | 4/2003 | Taimela | |
| 6,648,804 | B2 | 11/2003 | Chen | |
| 6,770,014 | B2 * | 8/2004 | Amore | 482/92 |
| 7,175,574 | B2 | 2/2007 | Carmel et al. | |
| 2003/0054924 | A1 * | 3/2003 | Amore | 482/92 |
| 2004/0053755 | A1 * | 3/2004 | Wilkinson | 482/124 |
| 2005/0113221 | A1 * | 5/2005 | Dovner et al. | 482/121 |
| 2008/0026922 | A1 * | 1/2008 | Smith | 482/124 |

* cited by examiner

*Primary Examiner* — Fenn C Mathew
(74) *Attorney, Agent, or Firm* — Douglas A. Scholer

(57) ABSTRACT

A portable exercise system includes a customizable pouch for positioning proximate the upper torso of a user, as well as customizable resistance bands. The resistance bands may detach from the pouch and be selected based upon a user's height, age, girth, preference, etc. The system may also include interchangeable handles for additional muscle training and memory, and therapeutic benefits. For instance, handle attachments may be squeezable and/or simulate a baseball. A back support and belt mechanism may be included where desired. The system may include attachments to facilitate exercise while sitting, e.g., traveling.

11 Claims, 5 Drawing Sheets

EXERCISE AND TRAINING APPARATUS

CROSS REFERENCE TO RELATED APPLICATION

This application claims the benefit of priority to Provisional Patent Application No. 60/974,235, entitled "Exercise and Training Apparatus," filed Sep. 21, 2007 by George Haynes, the application is incorporated herein by reference in its their entireties.

FIELD OF THE INVENTION

The present invention relates generally to exercise equipment, and more particularly, to muscle memory, therapy and portable exercise devices.

BACKGROUND OF THE INVENTION

Physical fitness is no more important today than it ever has been. However, in recent years the popularity of looking and feeling good has significantly increased, partly because we know how crucial being active is for our health, and also because of the influence of popular media. Conversely, not everyone takes a healthy, physical approach to get into or maintain their ideal shape; for example, many people engage in possibly dangerous diets, take diet pills, undergo potentially risky elective surgery, and use other seemingly unhealthy forms of weight-loss. Research shows that physical inactivity is the second leading preventable cause of death in the United States. Despite this fact, there are a number of reasons people do not employ this nourishing and natural approach to staying alive and healthy.

In the hustle and bustle of today's society, taking the time to be physically active, much less to exercise is not always convenient or feasible, despite it's value. It's hard to find time to make it to a gym, especially with a full-time job, a family, and/or other civil or extracurricular commitments. Even for those who don't have so many commitments, gyms may be pricey for those on a tight budget, or intimidating and uncomfortable for those who are self-conscious about working out in front of others. Not everyone lives in close proximity to a gym, which can also pose a problem. For those who desire to run or play sports outside to stay in shape, their environment may not be conducive to such activities (e.g.: climate and weather, safety of neighborhood or terrain, adequate daylight, etc.) For those who have the desire to workout at home, an at-home gym may be satisfactory. However, such equipment may be expensive and bulky. Another disadvantage to at home, or other gyms may be that the equipment is not versatile enough, especially for those on a time crunch; different machines target different muscle groups which can make a workout last longer. Equipment may also take up vast amounts of space (in the home, for example.) Also, not all people desire to lift weights—some may find it difficult, painful, or unsafe. This is especially the case for children and the elderly, whose physical fitness is important as well. In addition, some people don't like the idea of building large muscle, especially women, and desire only to take on aerobic activity. Engaging in only cardiovascular fitness is not always wise, as maintaining lean muscle increases metabolism, strengthens bone, and relieves pressure from joints and tendons. It is important to at least do some sort of resistance training to engage and tone the muscles. Properly performed, resistance training can provide significant functional benefits and improvement in overall health and well-being.

A non-weight bearing, safe and simple method of resistance training is through the use of exercise tubes that tone, stretch, and strengthen muscle, as well as elevate heart-rate. Exercise tubing consists of elastic tubes with handles that can substitute for free weights or machines. They come in various thicknesses to increase the tension (and are usually different colors to denote the tension). Exercise tubes are an inexpensive and versatile way to get started or maintain resistance exercise. Many exercises may be done with them, and they may even be used in a sitting position if the user doesn't get around very well on their feet. Another benefit to using resistance tubing is that it allows one to workout while simultaneously assuming other activities such as driving, working on a computer, or watching television. They are portable and may be packed conveniently in luggage bags for vacation, or left at the office for an occasional set of biceps curls when no one is looking! They don't dent the floor if you drop them as heavy weights do. They may also be stored easily in a drawer, closet, or other convenient, out-of-the-way location. Exercise tubing may be easily accessible at local superstores and sporting good stores.

In spite of the benefits outlined above, there are still a few flaws associated with not the exercise tubing itself, but more so to the equipment currently available. Because of the design and nature of exercise tubing, a few muscle groups are neglected by the currently available art. For instance, the neck and hands.

The neck is a very important muscle to keep strong and flexible. The neck area is prone to injury from sports, car accidents, improper sleeping positions, sitting and holding the head incorrectly or for too long while reading or working at a desk, inactivity in general, and moving to quickly, to name a few. The neck holds much of the physical stress of the body and the weight of the head and gets fatigued easily. The neck also is effected by emotional stress from headaches, sleeplessness and restlessness, which may result in neck spasms. If the muscles of the neck are not strong, even more strain is put on the neck, which leads to a never ending cycle of neck pain and full body problems originating at the neck. While there are machines and devices designed to exercise the neck, most are impractical, sometimes unsafe, awkward, embarrassing, or lack versatility. Even those devices comprising exercise tubing are flawed in that they are uncomfortable, hard to keep from rolling around or off the neck, and sometimes put even more stress on the neck and can potentially cause more harm than good. Also, current devices to work the neck deem inadequate in their ability to work other muscles of the body, which may be inconvenient for those who, as mentioned above, are already restricted on their ability or time to engage in fitness activities.

Regarding the hands, contraptions designed to work these muscles are few and far between. Strengthening the hands is not only for post-trauma rehabilitation, but may also prevent impairment of functionality. Exercising the hands may strengthen grip, increase dexterity, and improve mobility of the wrist. It promotes coordination, increase of range of motion, neuromuscular and balance training aid, aid in recovery, and may even reduce or prevent Carpal Tunnel Syndrome and arthritis symptoms. Currently, no exercise tubing devices are designed to work these important, but very often forgotten muscles, and especially while simultaneously working other muscles of the body, such as the arms, or even neck, as well.

Therefore, what is needed is a devise that is designed for the multipurpose exercising of all muscle groups of the body, including the neck and hands, that still encompasses the rest of the benefits of the current art. For instance, a device is needed that is inexpensive, simple to use, easily available, versatile in the location where the exercises may be performed and practical to use for persons of all shapes, sizes and ages, that is functional for those both extremely fit as well as unfit.

SUMMARY OF THE INVENTION

The present invention provides an improved exercise apparatus and method. The exercise apparatus comprises a semi-rigid structure, padded material at least partially enclosing the semi-rigid structure, a pouch at least partially enclosing the padded material and the semi-rigid structure, wherein the pouch is configured to substantially conform around an upper torso of a user, a resistance band having a first end attached to and extending from the pouch, and a handle attached to a second end of the resistance band.

The resistance band extends from two sides of the pouch and may be detachable at the first end. The detachable resistance band may be of a plurality of resistance bands including different tensions and handles configured to attach to the pouch.

Aspects of the invention have a handle that may be detachable at the second end. The handle may comprise at least one of a baseball and a softball and may be squeezable.

The apparatus may further comprise an attachment mechanism attached to the pouch. A belt may be configured to be worn by the user and to attach to the attachment mechanism. A strap may attach to the attachment mechanism and to the belt. A fastener and a strap may be configured to attach to, and a hood configured to slip over a chair back and attach to the attachment mechanism.

Embodiments of the invention may include a method of customizing the exercise device, comprising selecting a resistance band from among a plurality of resistance bands according to at least one of a strength and a physical attribute of a user, and attaching the selected resistance band to a pouch configured to be positioned proximate an upper torso of a user.

The method of the invention may comprise the pouch being selected from among a plurality of pouches based upon a size dimension of the user. One of a plurality of handles may be attached to the resistance band. A baseball may be attached to the resistance band such that the user may move the baseball in a throwing motion. A squeexable handle may also be attached to the resistance band. The pouch may also be manufactured to include a semi-rigid structure partially enclosed by padded material.

These and other advantages and features that characterize the invention are set forth in the claims annexed hereto and forming a further part hereof. However, for a better understanding of the invention, and of the advantages and objectives attained through its use, reference should be made to the Drawings and to the accompanying descriptive matter in which there are described exemplary embodiments of the invention.

DETAILED DESCRIPTION

Figure 1:
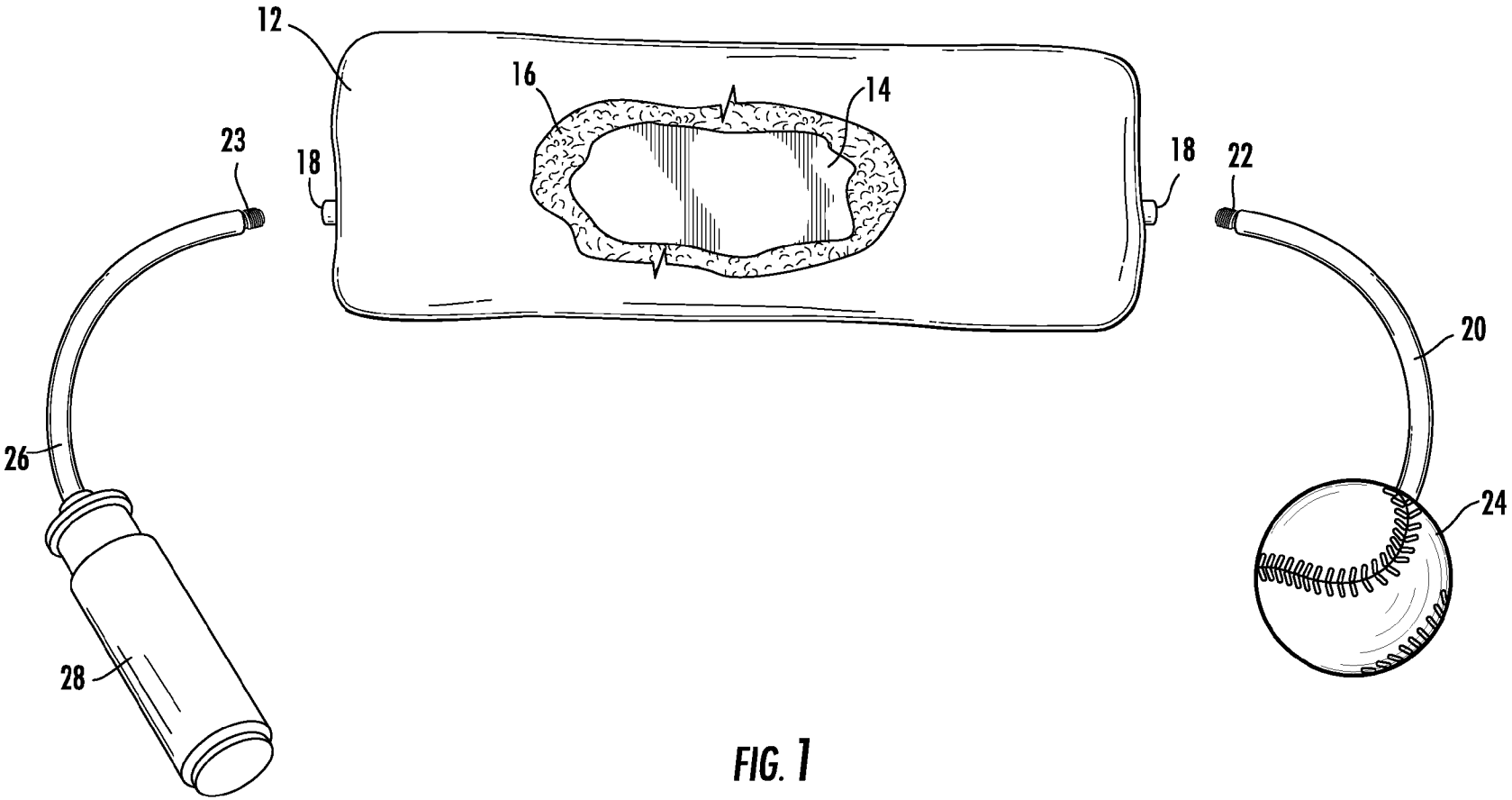
FIG. 1 shows an exercise system comprising a flexible pouch and resistance band in accordance with the underlying principles of the present invention.

FIG. 1 shows an exercise system 10 comprising a flexible pouch 12. The pouch includes a semi-rigid structure 14. The semi-rigid structure may be at least partially covered by padding 16. The semi-rigid structure 14 and padding 16 may be loosely or fixedly contained within the pouch 12.

The pouch 12 may include leather, cloth, vinyl or another material suited to loosely, but firmly contain the semi-rigid structure 14 and padding 16. The combination of the pouch 12, semi-rigid structure 14 and padding 16 may cooperate to comfortably conform around the neck and/or upper torso of a user.

The pouch may also include a connector 18. The connector 18 may attach to a mating connection 22, 23 of a resistance band 20, 26. An exemplary resistance band 20, 26 may include tubing, rubber or another stretchable material. Tension in the resistance band 20,26 may promote muscle training, therapy, memory and/or development. For purposes of this specification, a connector, fastener or other attachment mechanism may include any known device(s) for detachably or permanently (when desired) attaching objects to one another.

The resistance band 20 may include a handle 24. While not shown in the embodiment of FIG. 1, the resistance band 20 may detachably attach to the handle 24. Such a detachable quality may provide interchangeability and customizable options. For instance, resistance bands may be selected based upon their length and/or relative tension. Alternatively, the attachment band 20 may permanently attach to the handle 24. In another embodiment, a single resistance band may attach to the pouch and include handles on both ends.

FIG. 1 also includes another attachable resistance band 26 having a different handle 28. The handle 24 may comprise a rigid structure, such as a baseball. The user may practice throwing the baseball handle 24 while simultaneously experiencing resistance (via the resistance band 20) during the throwing motion. Alternatively, the handle 24 may be squeezable such that a user may squeeze the handle 24 while simultaneously extending the resistance band 20. The compressibility of the such a squeezable handle may aid in the development of hand and arm strength, and may combat certain medical conditions, such as carpal tunnel syndrome.

Where so desired, the different components of the exercise apparatus 10 may be customized for particular users. For instance, the resistance bands 20 may be selected based upon the arm length, strength, color preference, rehabilitative stage and/or age of the user. Similarly, the pouch 12 may be sized to optimally fit the particular dimensions of different users of differing ages, heights and girths. Handles may similarly be selected separately for inclusion, or as already attached or comprising part of the resistance band. In one application, a user may be fitted for the customized equipment at the point of sale or treatment.

Figure 2:
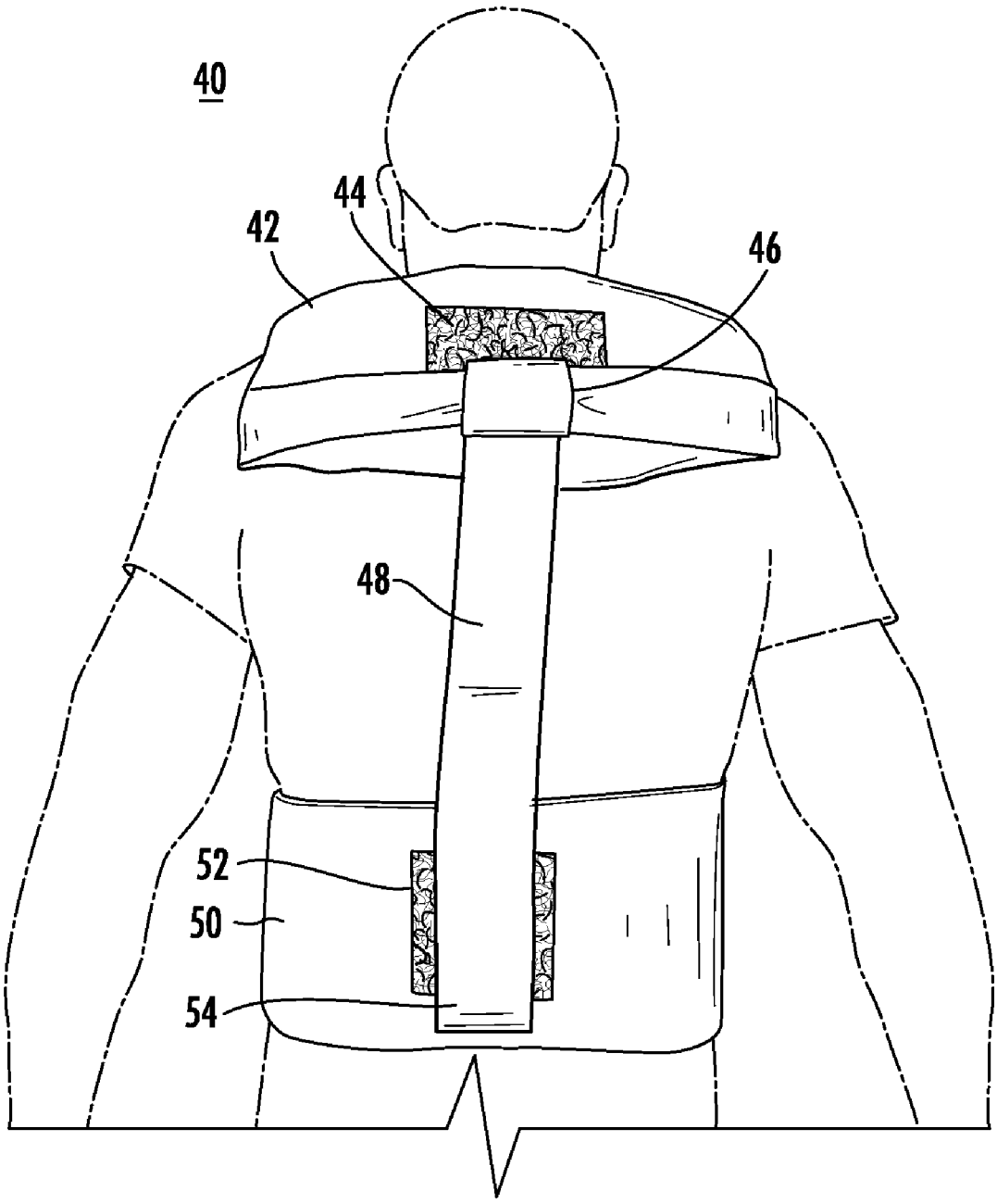
FIG. 2 shows an exercise system including a back support consistent with the underlying principles of the underlying invention.

FIG. 2 shows an exercise system 40 having a back support consistent with the principles of the underlying invention. A system 40 includes a pouch 42 positioned proximate the neck and/or the upper body of a user. The pouch 42 includes an attachment mechanism 44. An exemplary attachment mechanism may include a hook and loop type fastener. The pouch may also include a mating attachment mechanism configured to attach the attachment mechanism 44 to a connecting strap 48. The connecting strap 48 may connect to and translate support from a belt 50. The belt 50 may include a fastener 52 and a corresponding connector 54.

Figure 3:
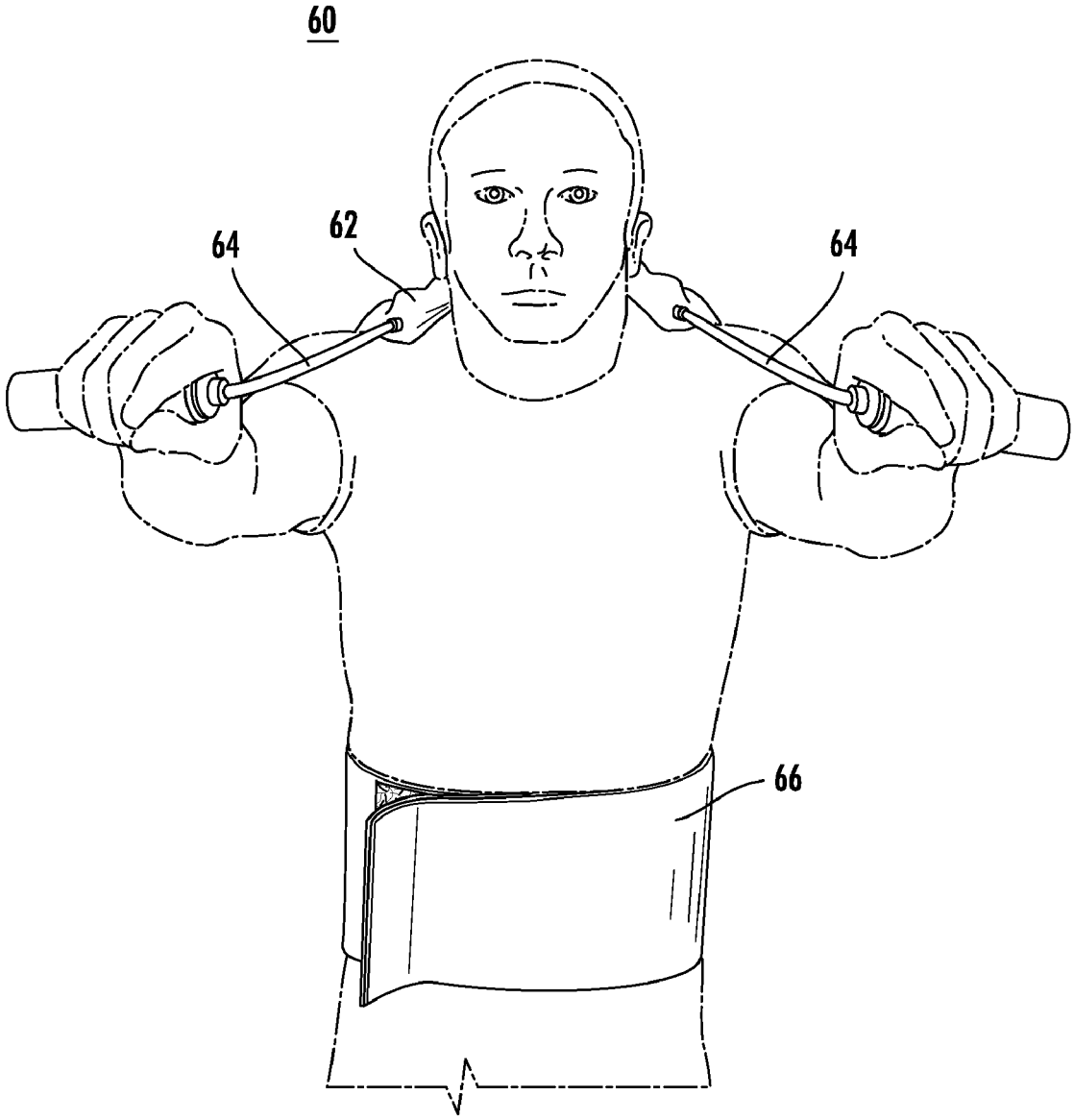
FIG. 3 shows an exercise system including a back support and resistance bands consistent with the underlying principles of the underlying invention.

FIG. 3 shows another exercise apparatus 60 in accordance with the underlying principles of the present invention. The system 60 includes a pouch 62 configured to conform to the contours of a user's back and neck. The user may extend the resistance band 64 while receiving support from a belt 66.

Figure 4:
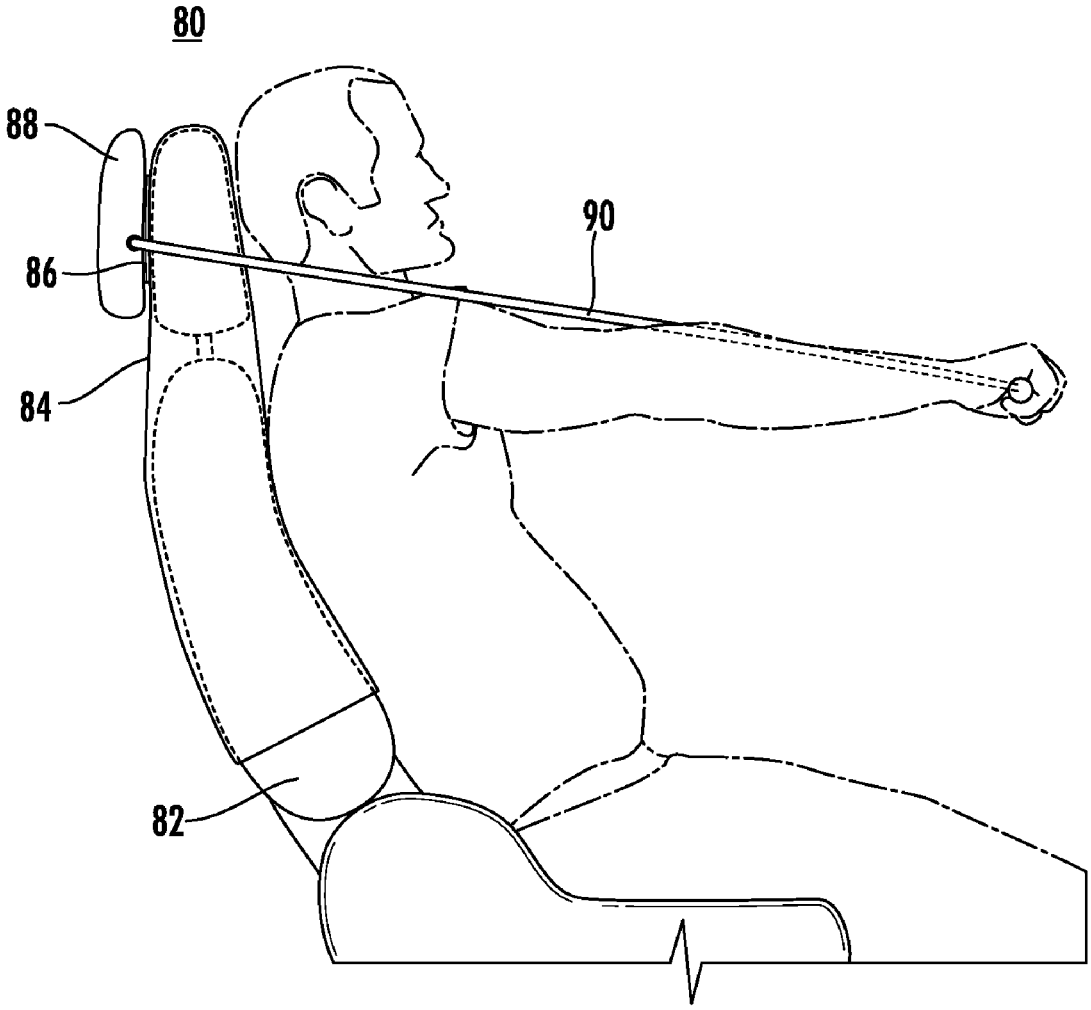
FIG. 4 shows an exercise apparatus suited for use while in an automobile or while otherwise seated in accordance with the underlying principles of the present invention.

FIG. 4 shows an exercise apparatus 80 suited for use while in an automobile or while otherwise seated in accordance with the underlying principles of the present invention. The system 80 includes a hood 84 configured to fit over a car seat 82. The hood includes an attachment 86 configured to attach to a mating fastener on the pouch. The user may extend the resistance bands 90 and exercise while the fasteners 86 and hood 84 keep the pouch 88 in place. The hood may include any material suited to slip over and/or attach to a chair back, e.g., while at work or traveling. Alternatively or additionally, a strap of another embodiment may wrap around the chair back and attach to a mating fastener of the pouch. One of skill in the art will appreciate that the hood of another embodiment may be of any particular length, and the pouch may alternatively be positioned between the seat and the back of the user's head. In such a configuration, the attachment may work in conjunction with pressure from the back of the user's head to keep the pouch in place.

Figure 5:
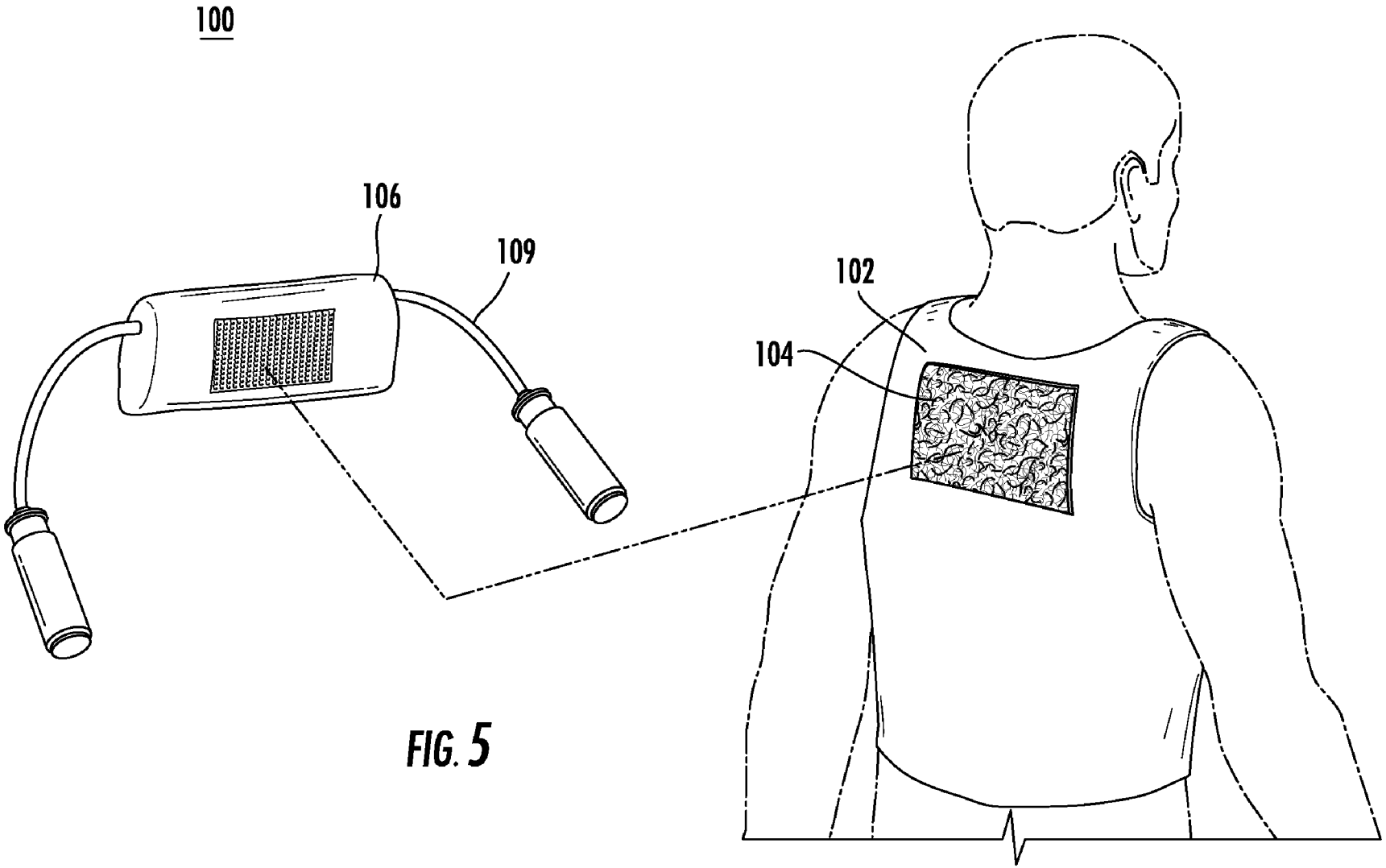
FIG. 5 shows an exercise system that includes a vest or other apparel item in accordance with the underlying principles of the present invention.

FIG. 5 shows an exercise system 100 in accordance with the underlying principles of the present invention. The system 100 includes a vest 102 or other apparel item. The vest 102 includes a fastener 104. The fastener 104 is configured to attach to a pouch 106. The user may exercise using the resistance bands 109 while the pouch 106 remains in place by virtue of the attachment 104 to the apparel 102.

As such, embodiments may be used while a user is running or walking resulting in both a leg and arm workout. The equipment is not as dangerous as carrying weights because it is easy to let go of when a person becomes winded. Not only can a user let go of the equipment when they feel winded, but they also do not have to leave their equipment behind as they progress forward in their workout.

Aspects of the invention may contain apparel, allowing for equipment that one may virtually take anywhere they want to go. The equipment may essentially be hooked to the user with Velcro attached to the pouch, as well as a vest or belt.

The equipment allows for a user to feel comfortable while using it. Other similar devices are uncomfortable or embarrassing to use because a user cannot get situated, or feels silly wearing the device.

The device comes in different sizes and strengths to accommodate different user demographics. For instance, smaller pouches with lighter resistance tubing are made for both women and children. Devices designed for children are also easier to use than some other exercise equipment. Also, the apparatus appeals to children and the elderly because it is non-weight bearing, but still tones muscles and helps burn fat. This is helpful because children should not do weight bearing exercises. The elderly should also not use weights, as their joints and bones are more fragile and easier to break.

For those of different strengths, embodiments of the invention are advantageous because it is not difficult to stop an exercise mid-repetition like it would be with weights or machines. It would be dangerous to quickly drop a weight on the floor, whereas the resistance bands weigh virtually nothing (compared to a weight). Because of the pouch, the system will stay in place and is easy to access when the user is ready to continue on with their set.

Aspects of this invention may be appealing to many different types of users and athletes, no matter what shape they may be in. This is achieved through adjustable and exchangeable tubing for all strength levels, as well as the nature of the resistance training, itself. The tubes may be used by martial arts trainers, bodybuilders, runners, as well as those seeking overall physical fitness. Also, the physically handicapped, and mentally challenged may desire to use the exercise tubes and pouch for their simplicity and ease of use.

Unlike many other devices which could actually cause injury, the tubes may also be used for prevention purposes from such ailments such as rotator cuff injury (often a problem in those who workout extensively), or Carpel Tunnel Syndrome (especially from spending long days typing on a computer), to name a few. Prevention occurs because using bands engages deep muscle tissues close to the joints, thereby protecting those joints—other machines and devices will not target muscles this deep while still providing a quality workout. This is partly attributed to the fact that one may achieve a higher number of repetitions with the resistance bands than with free weights or machines. Higher repetitions with resistance bands engage deeper within the muscles, but still give good workouts because the resistance felt at the top of a repetition from the band and something weight baring may be the same. The difference is that with resistance bands, the squeeze at the top is the most difficult in relation to energy expended and muscle engaged, whereas with a weight, energy is expended and the muscle is engaged during the entire range of motion of the repetition, not just at the peak squeeze.

Orthopedics and physical therapists may take advantage of embodiments of the invention. For those needing surgery, circulating blood throughout the soon to be operated areas is important. And for those having had surgery, or having been in a car accident, or experienced some other type of injury, the apparatus engages many ranges of motion of all bodily injuries. The Velcro belt, as mentioned above, may take all the strain off of the neck during rehabilitation if a neck injury was sustained, unlike other workout equipment.

Among other advantages, aspects of the present invention are beneficial because of its versatility. Aspects of the invention employ exercises for all areas of the body, including the neck, chest, shoulders, arms, wrists, fingers, abdomen, upper and lower back, and legs. The pouch allows for triggering muscles in the mentioned parts of the body because of the versatility of where it may be placed on the human body. Pouch positions may include, behind the head, on the upper or lower regions of the back, as well as while sitting, standing and lying on it. As indicated, various exercises may be performed in a number of positions, such as while standing, while lying down on the floor or in bed, while moving (e.g.: walking/running), and while sitting in a chair, on the couch, on a plane, sitting on a fit ball at the gym, at ones desk at work, or even in the car. No other apparatus may give you a full body workout whether sitting or lying (as well as standing).

The fit ball at the gym allows for many core focused and balance exercises. Doing bicep, tricep, chest, back or shoulder exercises on the ball are extremely advantageous because they engage many parts of the body at once. However, they may be potentially dangerous when used with a dumbbell or barbell because if one loses their balance, they are more likely to sustain an injury due to the weight they're holding, as well as their inability to quickly break their fall. The present apparatus minimizes this type of injury because it is lightweight and easy to let go of if balance is lost.

Aspects of the invention may minimize the negative effects of long hours on a computer and in a desk chair by relieving stress in the neck and wrists of the user and decreasing tension and the onset of stress headaches. Also, circulation, which is lost during long periods of sitting, may also be increased with the use of the present device.

Embodiments of the invention allow for exercising while in the car through an apparatus for hooking the pouch to the headrest. This is beneficial for a number of reasons, including not wasting time doing nothing in traffic or at long stop lights, and stopping on the side of the road during extensive driving trips to get oxygen into the bloodstream and increase heart-rate, which may inturn decrease monotony and sleepiness. Aspects of the present invention are useful in the car because when traffic starts up again after a stop light, or it is time to get going after a driving break, there is no hassle of putting away the exercise gear. A person simply let's go of the device, leaving it in a stationary position and easily accessible for the next light or break.

Other benefits attributed to the use of the present invention include the fact that with this apparatus, one may stretch, and build and tone muscle, as well as increase energy without causing soreness, unlike many other devices.

While the present invention has been illustrated by a description of various embodiments and while these embodiments have been described in considerable detail, it is not the intention of the Applicant to restrict, or, in any way limit the scope of the appended claims to such detail. The invention in its broader aspects is therefore not limited to the specific details, representative apparatus and method, and illustrative example shown and described. Accordingly, departures may be made from such details without departing from the spirit or scope of Applicant's general inventive concept.

What is claimed is:

1. An exercise apparatus, comprising:

a semi-rigid structure;

padded material at least partially enclosing the semi-rigid structure;

a pouch at least partially enclosing the padded material and the semi-rigid structure, wherein the pouch is configured to substantially conform around an upper torso of a user, wherein the pouch includes a first connector and a second connector positioned at opposing ends of the pouch;

a first detachably removable resistance band having a first end configured to be coupled to the first connector;

a second detachably removable resistance band having a first end configured to be coupled to the second connector;

a first handle attached to a second end of the first detachably removable resistance band; and a second handle attached to a second end of the second detachably removable resistance band.

2. The exercise apparatus of claim 1, wherein the first resistance band is one of a plurality of resistance bands including different tensions configured to attach to the pouch.

3. The exercise apparatus of claim 1, wherein the first handle is detachable at the second end of the first detachably removable resistance band.

4. The exercise apparatus of claim 1, wherein the first handle is squeezable.

5. The exercise apparatus of claim 1 further comprising an attachment mechanism attached to the pouch.

6. The exercise apparatus of claim 5, wherein a waist encircling a belt is configured to attach to the attachment mechanism.

7. The exercise apparatus of claim 1, wherein the first end of the first detachably removable resistance band includes a mating connection.

8. The exercise apparatus of claim 1, further comprising a waist encircling belt.

9. The exercise apparatus of claim 1, further comprising a connecting strap configured to be coupled to the waist encircling belt and the pouch, wherein the connecting strap is further configured to communicate support to a user from the waist encircling belt.

10. The exercise apparatus of claim 1, wherein a size of the pouch is selected from a plurality of different sized pouches according to a size of the user.

11. The exercise apparatus of claim 1, wherein the first detachably removable resistance band is selected biased upon a physical characteristic of the user.

* * * * *